US006224457B1

(12) United States Patent
Wu

(10) Patent No.: US 6,224,457 B1
(45) Date of Patent: May 1, 2001

(54) KNOCKDOWN STYLE SAFETY DISK-SHOOTING TOY

(76) Inventor: Wen-Long Wu, No. 5, Alley 26, Lane 62, Tung-Hsing Rd., Ta-Li City, Taichung Hsien (TW)

( * ) Notice: Subject to any disclaimer, the term of this patent is extended or adjusted under 35 U.S.C. 154(b) by 0 days.

(21) Appl. No.: 09/478,083

(22) Filed: Jan. 6, 2000

(51) Int. Cl.[7] ..... A63H 33/30; A63H 17/00; A63H 33/26; F41A 9/00

(52) U.S. Cl. ..... 446/473; 446/435; 446/485; 124/42

(58) Field of Search ..... 446/473, 475, 446/483, 435, 485, 487, 489; 124/42, 43

(56) References Cited

U.S. PATENT DOCUMENTS 3,191,588 * 6/1965 Thew ..... 124/42 X
3,515,114 * 6/1970 Carbonneau ..... 124/42 X
4,170,215 * 10/1979 Kettlestrings ..... 124/42 X
4,659,320 * 4/1987 Rich et al. ..... 446/435
4,668,205 * 5/1987 Choy et al. ..... 446/487 X
4,910,646 * 3/1990 Kim ..... 124/42 X
5,145,446 * 9/1992 Kuo ..... 446/485 X

* cited by examiner

*Primary Examiner*—D. Neal Muir
(74) *Attorney, Agent, or Firm*—Bacon & Thomas, PLLC

(57) ABSTRACT

A knockdown style safety disk-shooting toy mainly comprises a gadget platform coupling with a handgrip which can be plugged in an insertion pillar to form a hand-held or an automatic shooting toy alternatively in virtue of a positive/negative electrode plate that extends sound and light effect to a machine base and a transmission device that drives a laser gun to sway back and forth for disk-shooting.

2 Claims, 10 Drawing Sheets

KNOCKDOWN STYLE SAFETY DISK-SHOOTING TOY

BACKGROUND OF THE INVENTION

This invention relates generally to a disk-shooting toy, more particularly, it relates to a safety disk-shooting toy with sound and light effect that can be dismounted to become a hand-held style or combined to form a self-propelled toy.

Sound and light effect seems to be the most popular appended function to a toy nowadays that is greatly attractive to the adults not to mention the kids.

It is all right that the accompanying sound and light effect of a shooting toy is one of the stimulating and exciting inducers, however, the hard pellets in use so far may hurt people accidentally, and because of the complicated structure of the present shooting toys, the high production cost and difficult retrieval of the pellets hinder the further popularization.

SUMMARY OF THE INVENTION

The primary object of this invention is to provide a knockdown style safety disk-shooting toy used to shoot disks with sound and light effect that can be separated to become a hand-held style or combined to form a self-propelled toy.

In order to function as abovesaid, this invention mainly comprises a gadget platform coupled with a handgrip, which, the handgrip, is plugged in an insertion pillar of a machine base, and by advantage of a positive/negative electrode plate, the sound and light effect can be transmitted to the machine base, and with assistance of a transmission device, a laser gun can sway back and forth for shooting disks.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
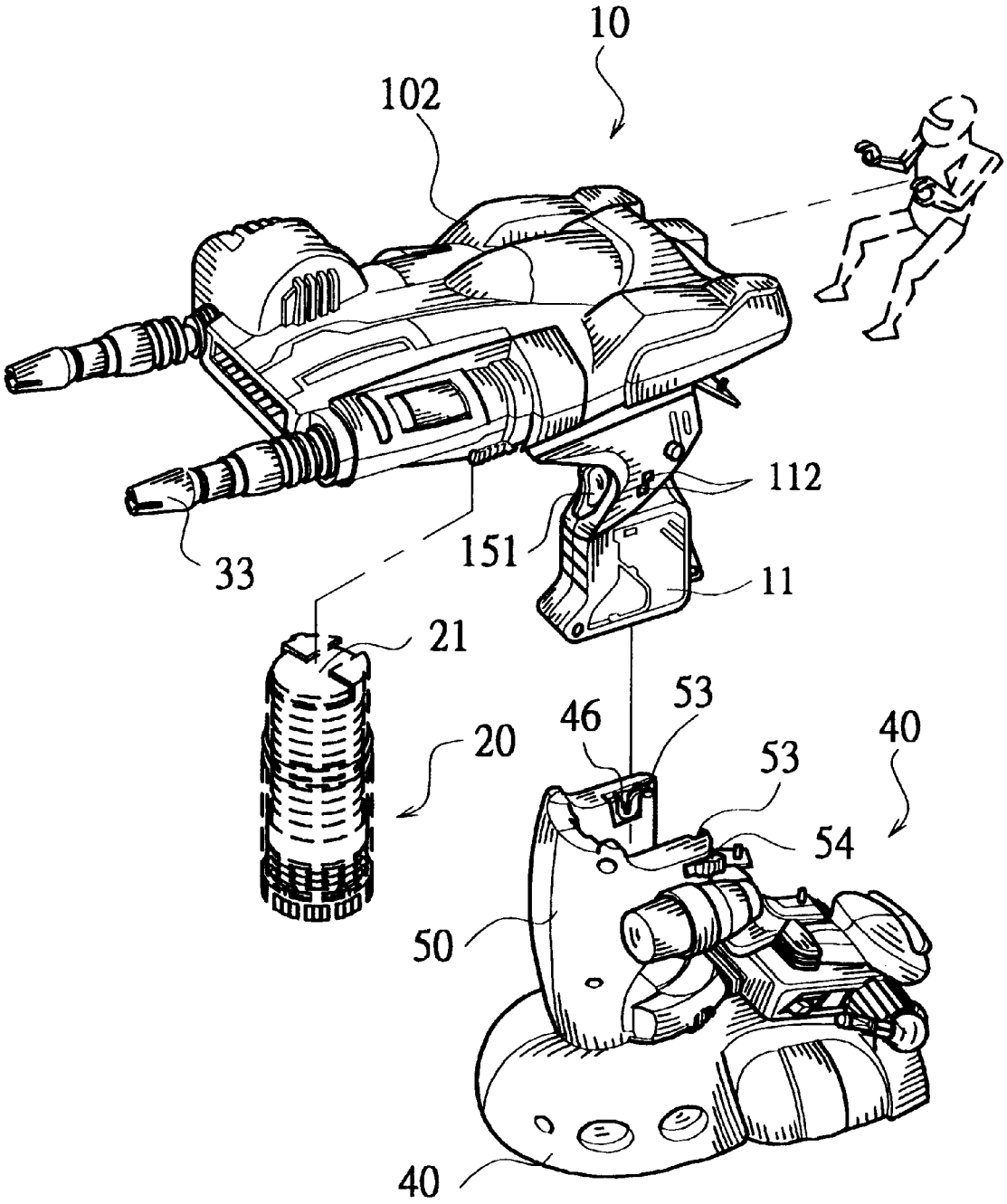
FIG. 1 is a three-dimensional exploded view of this invention.
Figure 2:
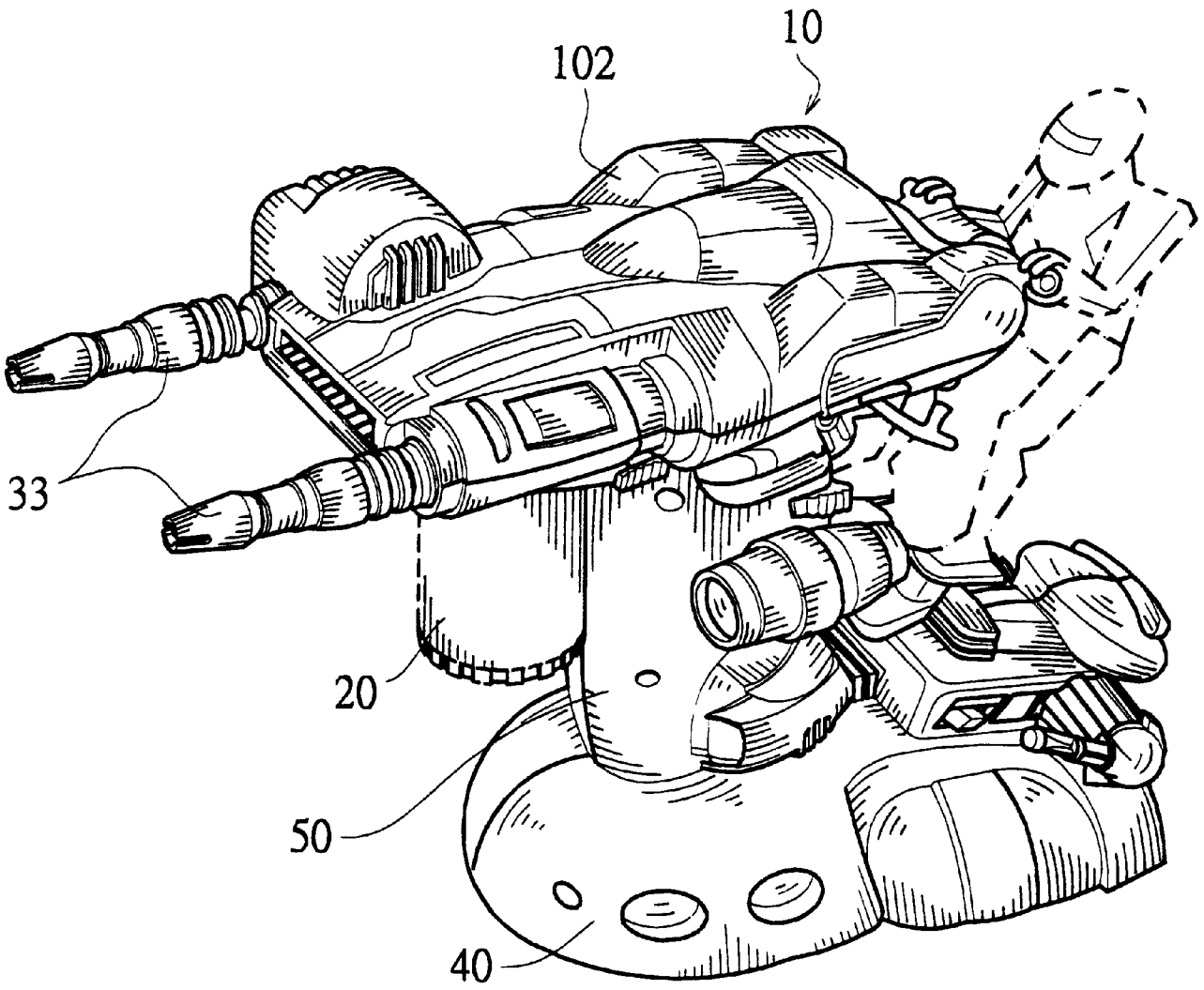
FIG. 2 is a three-dimension elevational view of this invention.
Figure 3:
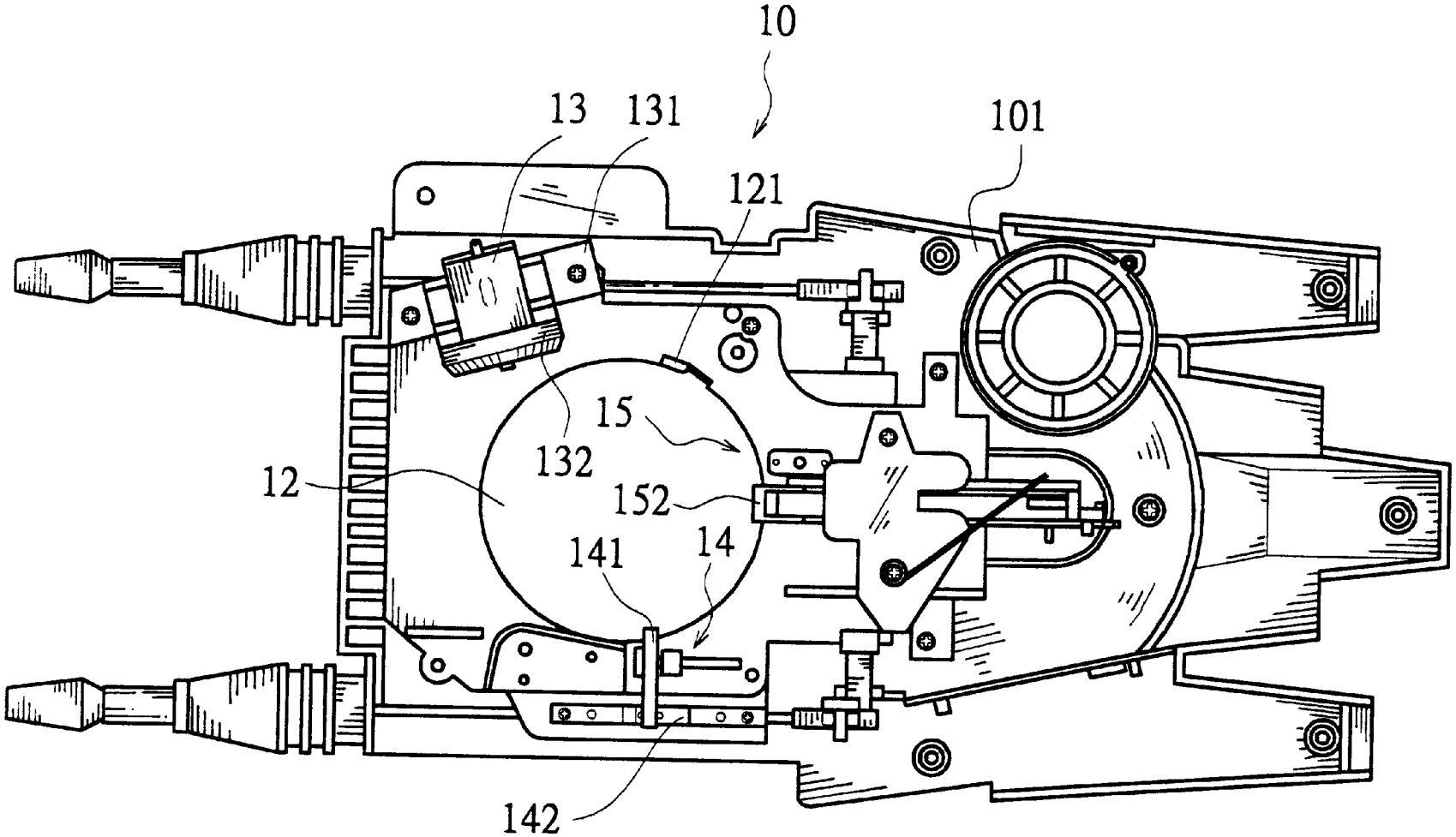
FIG. 3 is a top view of this invention without showing a modeling case cover.
Figure 4:
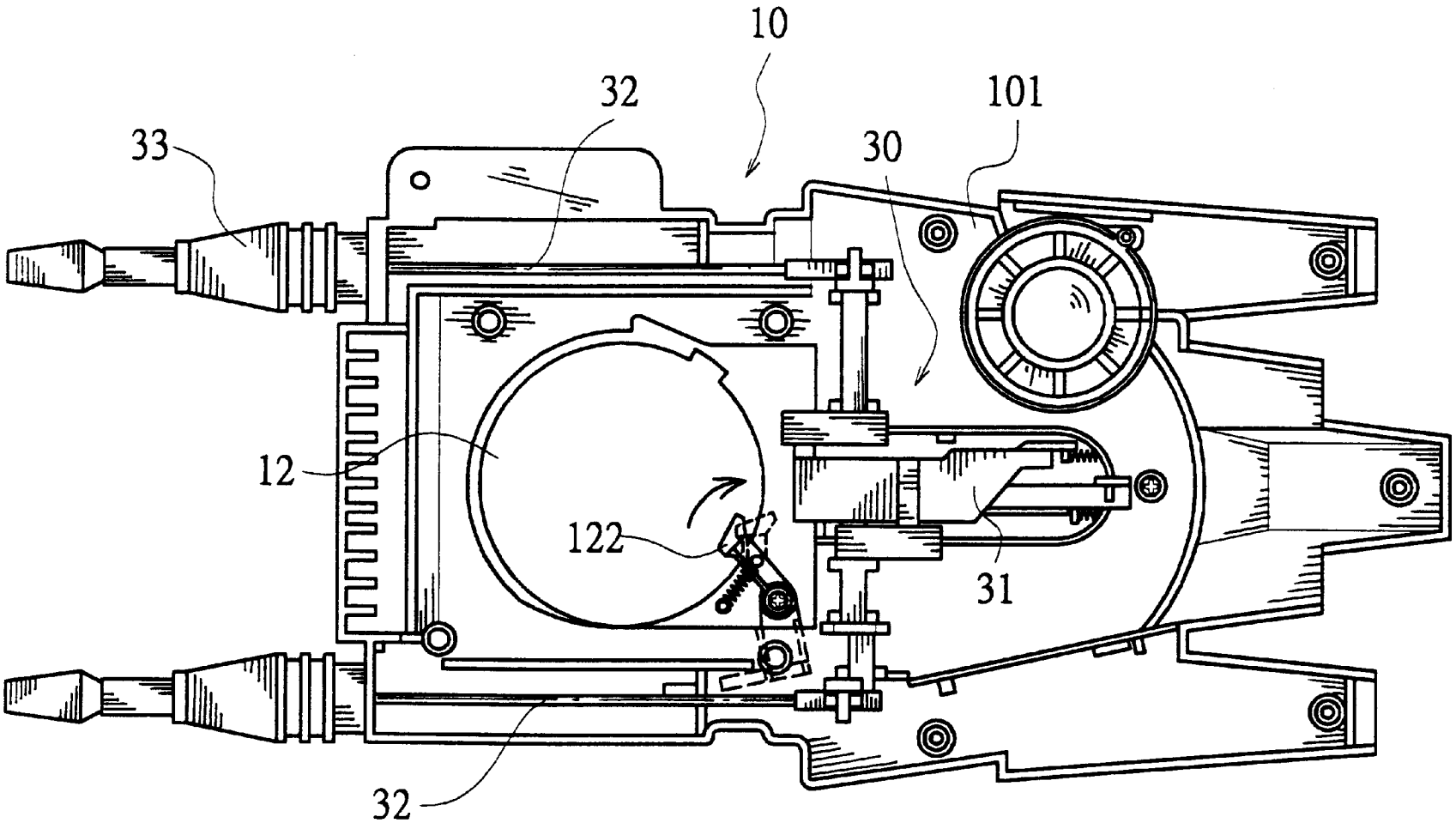
FIG. 4 is a top view of this invention without showing a disk-feeding device.
Figure 5:
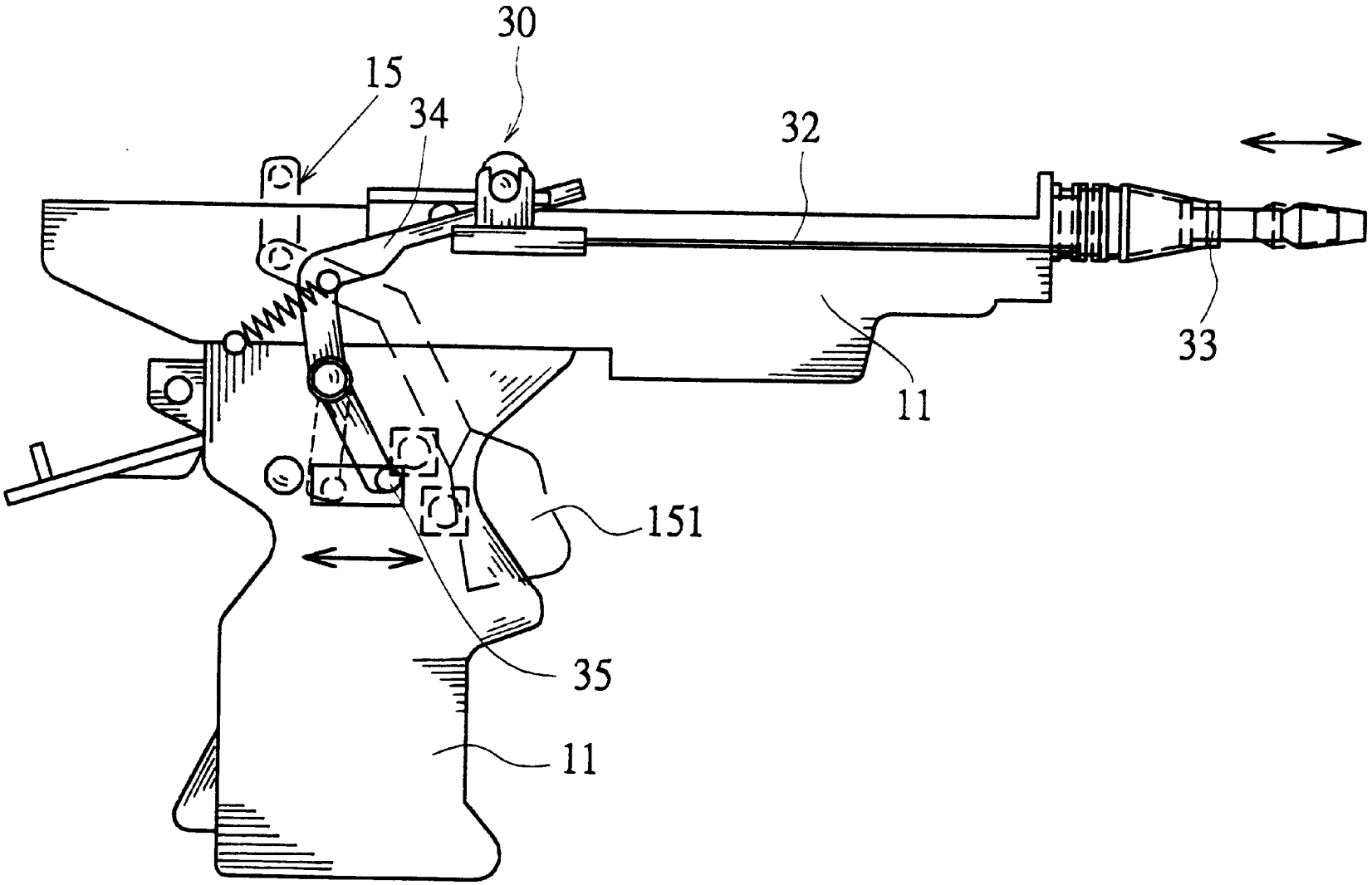
FIG. 5 is a schematic view of a thrust device of this invention.
Figure 6:
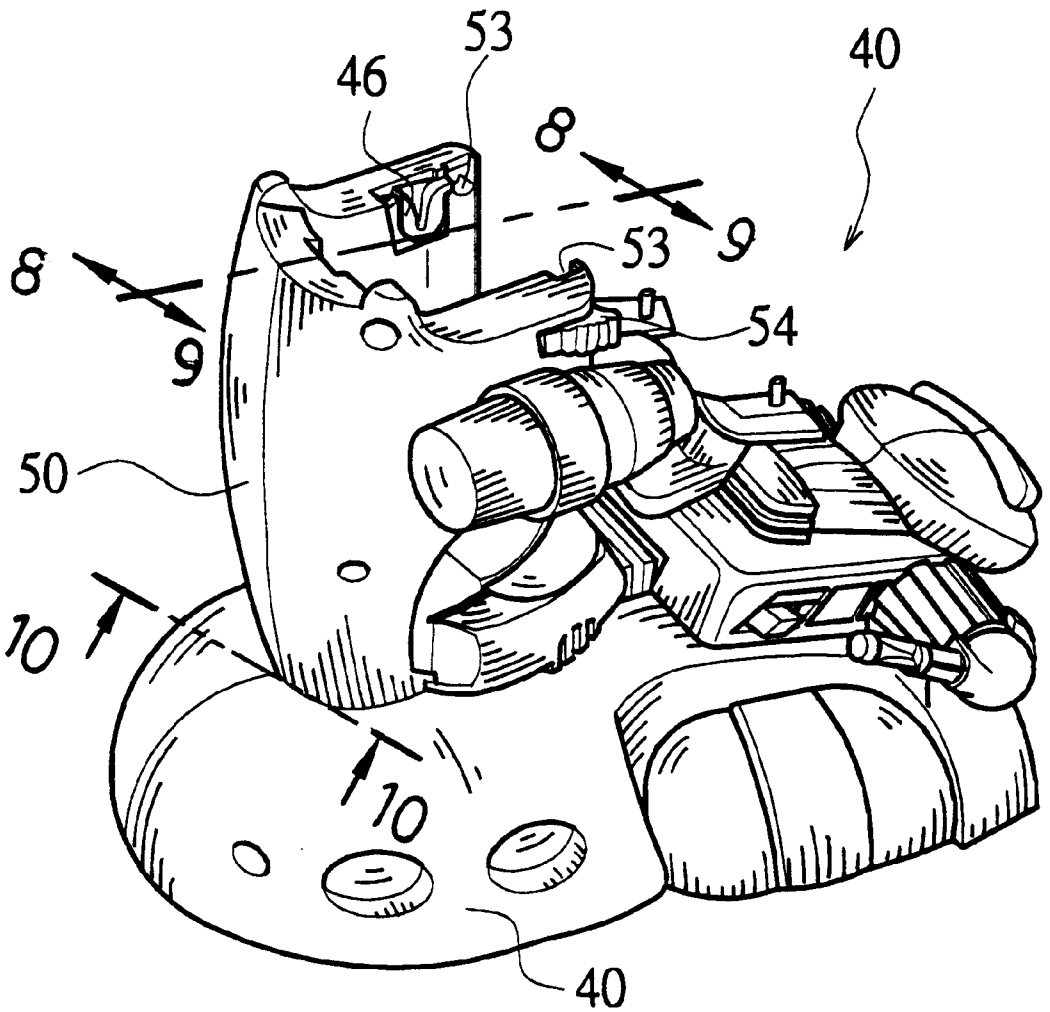
FIG. 6 is an outline view of a machine base of this invention.
Figure 7:
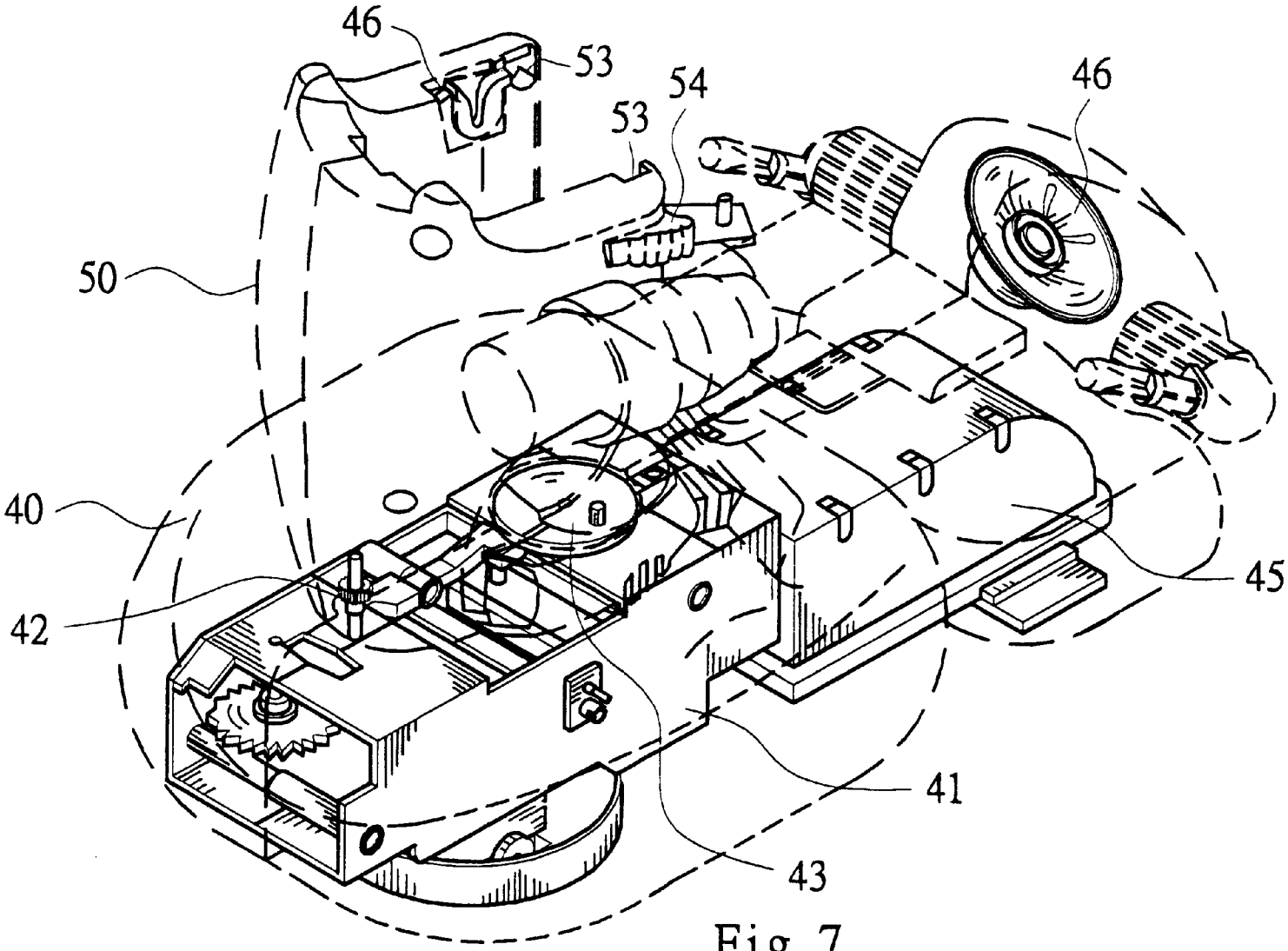
FIG. 7 is a schematic view showing disposition of a deflection device, a battery chamber, and a sound generator of this invention.
Figure 8:
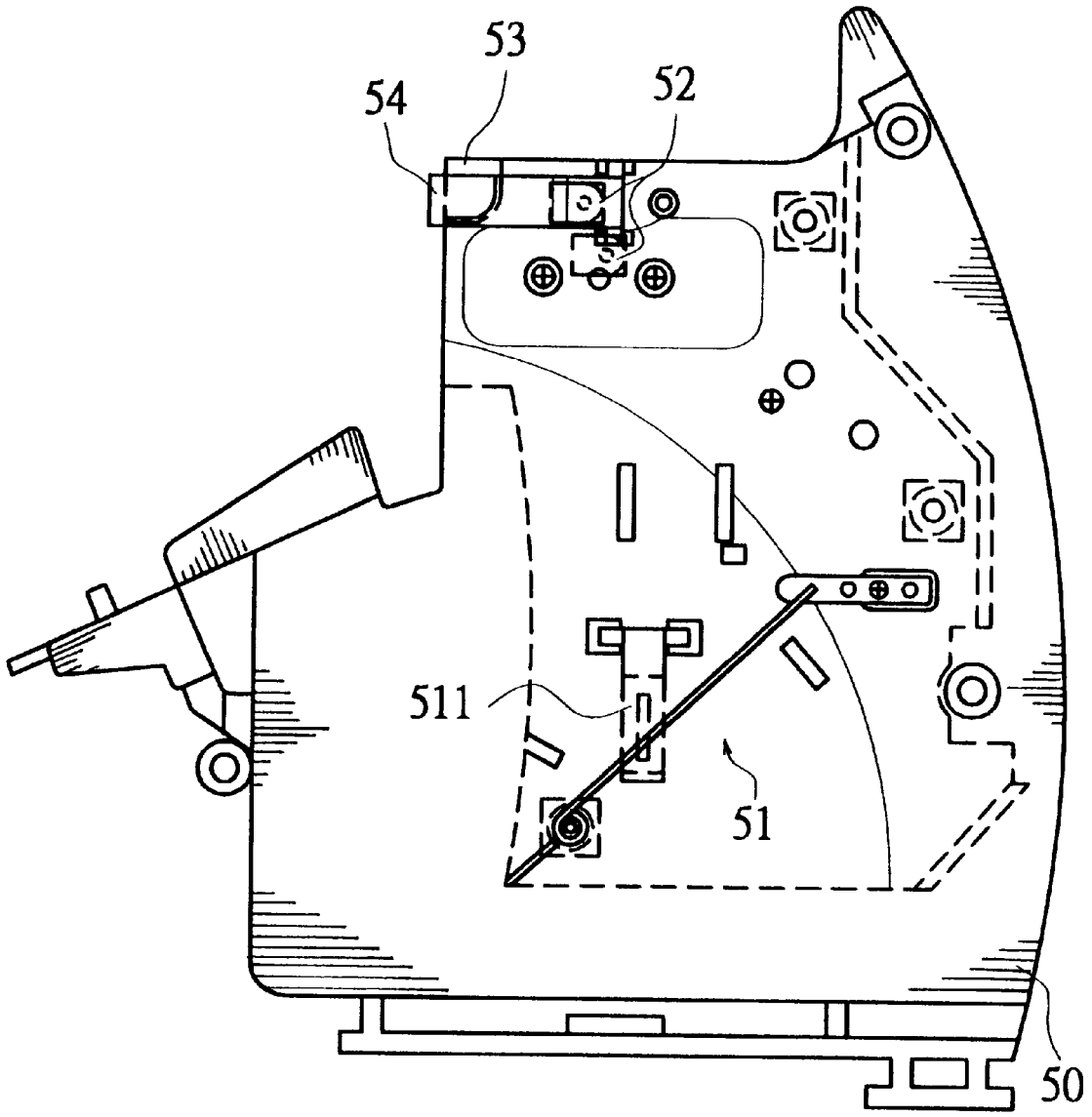
FIG. 8 is a cutaway sectional view taken along dotted line 8—8 in FIG. 6 (view of a start switch)
Figure 9:
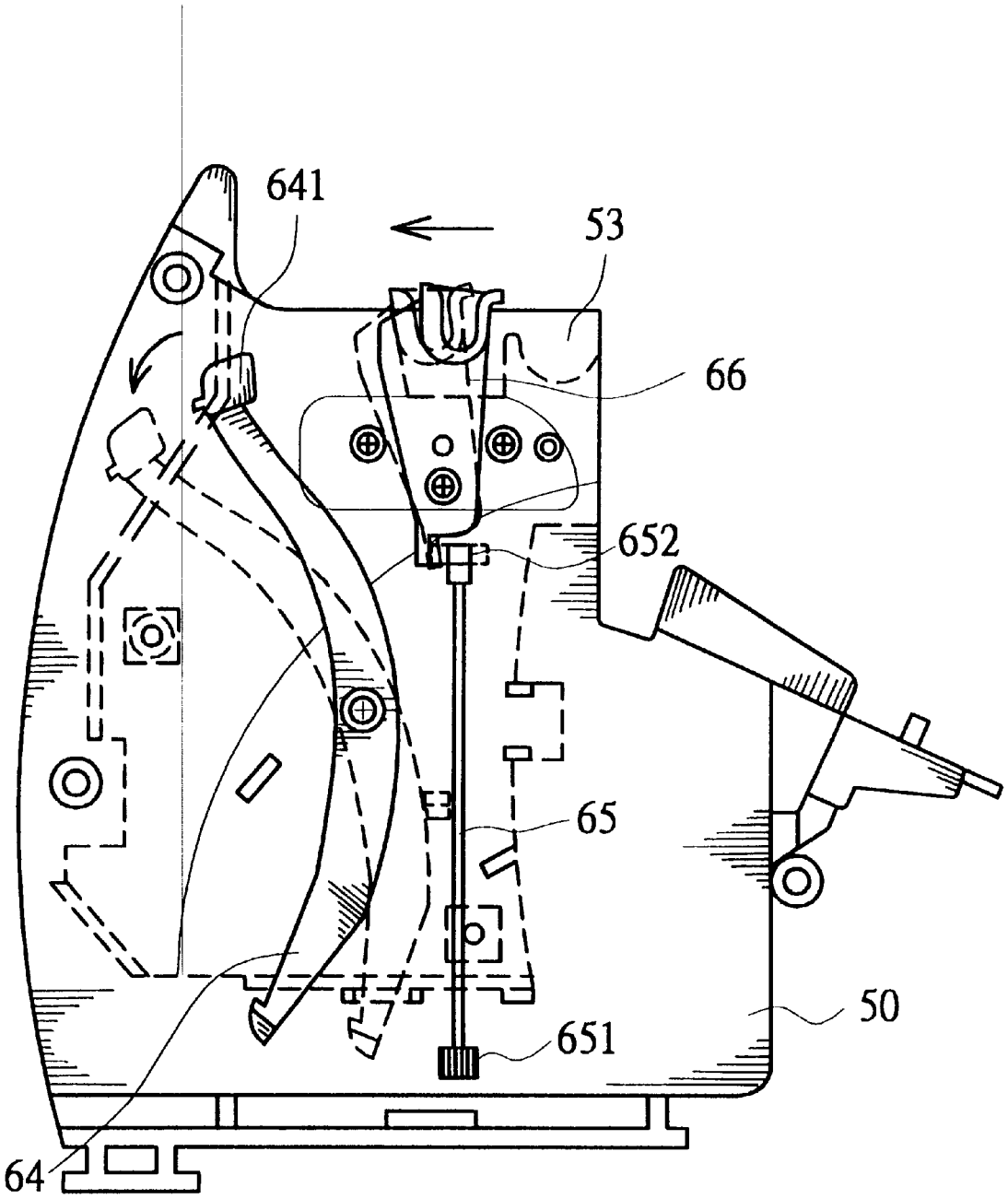
FIG. 9 is a cutaway sectional view taken along dotted line 9—9 in FIG. 6 (view of a sway switch of a laser gun)
Figure 10:
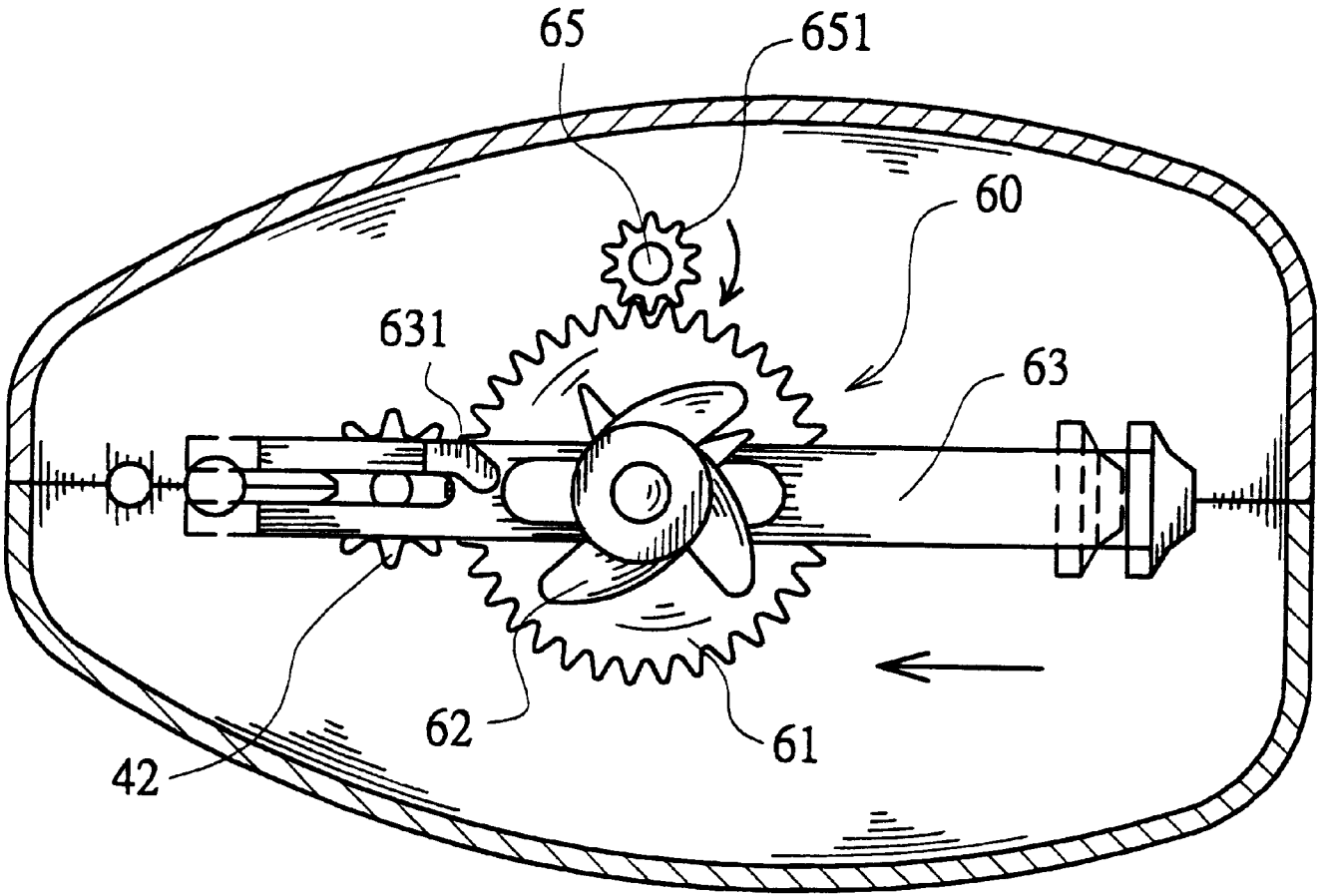
FIG. 10. is a cutaway sectional view taken along dotted line 10—10 in FIG. 6 (view of a steering switch).

As shown in FIG. 1 through FIG. 10, this invention mainly comprises a gun body 10 with sound and light effect, a feeding device 20, a thrust device 30, and a machine base 40.

A gadget platform 101 and a modeling case cover 102 are located on the gun body 10 while a hollow handgrip 11 and a battery power device 111 located thereunder are disposed under the gun body 10. A positive/negative electrode plate 112 is located at one side of the handgrip 11 for communicating with sound and light effect, and a protrusive snap dot 113 is formed on each of two lateral faces of the handgrip 11. A feeding mouth 12 is disposed axially at a front edge of the gadget platform 101, wherein a positioning slide channel 121 is arranged at an inner edge of the feeding mouth 12, and an insert-to-fix knob 122 is disposed at an opposite lateral wall of the positioning slide channel 121. A transmission motor 13 located in a silent seat 131 is fixed on the gadget platform 101 indirectly, wherein the shaft of the transmission motor 13 points inwards slightly in a predetermined deflection angle and elevational angle; a ratchet wheel 132 is attached at one end of the transmission motor 13 which is coupled with a start device 14 by a power cord; and a disk-feeding device 15 is positioned behind the feeding mouth 12.

The start device 14 contains a sway block 141 pivotally disposed at an adjacency of the feeding mouth 12, wherein an outer edge at one end of the sway block 141 is extended inwards while an ON/OFF switch 142 is placed under the other; the switch 142 is connected with the battery power 111 and the transmission motor 13 respectively by a power cord; and the start device 14 is used to start the transmission motor 13 for driving the ratchet wheel 132 to rotate at high speed.

The disk-feeding device 15 is disposed on the gadget platform 101, and a trigger 151 is protrusively arranged laterally to the handgrip 11, wherein the trigger 151 will drive a push lever 152 on the gadget platform 101 to feed a disk 21.

The feeding device 20 is an open cylinder installed under the feeding mouth 12 for loading a plurality of disks 21, wherein an insert-to-fix hole 22 is formed in the circumference of the feeding device 20 for grasping the insert-to-fix knob 122 of the gun body 10 to prevent the feeding device 20 from slipping downwards.

The thrust device 30 on the gadget platform 101 is formed by disposing a long rod 32 on each side of a crank 31, and the long rods 32 are extended over the gadget platform 101 to form barrels of a laser gun 33 with sound and light effect, wherein the crank 31 is driven by an interaction lever 34 to enable the laser gun 33 to sway back and forth, and a protrusive knob 35 is jointed with a tail end of the interaction lever 34 and located outside the handgrip 11.

The machine base 40 is provided with wheels and a deflection device 41 at its bottom portion to enable the machine base 40 to deflect automatically when it bumps against another body. A transmission gear 42 and a turntable 43 are located on the deflection device 41, and a battery box 45 is placed laterally to the deflection device 41. Moreover, a sound generator 46 (speaker) is disposed on the battery box 45, and an insertion pillar 50 is arranged on the machine base 40.

The insertion pillar 50 is a hollow body for inserting the handgrip 11 of the gun body 10 to form an integral unit, wherein a pushbutton 511 of a power starting device 51 is disposed laterally in the insertion pillar 50, and when a user keeps the pushbutton 51 pressed, the power supply is started. Above the power starting device 51, a positive/negative electrode plate 52 is arranged to connect with the sound generator 46, wherein a dimple 53 is formed at a top end of an inner edge of each lateral face on the insertion pillar 50;

a press knob 54 is disposed at an outer side of the dimple 53 for snap-fixing the protrusive snap dot 113 of the handgrip 11 when the gun body 10 is combined with the machine base 40 so that the combination can be separated again by pressing the press knob 54; and a transmission device 60 is laid under the insertion pillar 50.

The transmission device 60 is substantially a large gear 61 engaged with the transmission gear 42 of the deflection device 41, wherein a cam 62 with a plurality of tappets is pivotally disposed above the large gear 61; a slide rod 63 with a protrusive piece 631 at its one end is interfaced between the cam 62 and the large gear 61 so that the slide rod 63 can be driven to move right and left following movement of the protrusive piece 631 according to rotation of the cam 62; a weight block 632 protrusively arranged at the other end of the slide rod 63 is used to push one end of a sway crank 64 located laterally to the insertion pillar 50; and a press block 641 is fixed at the other end of the sway crank 64 for pressing the trigger 151 of the handgrip 11 to shoot a disk 21 indirectly. Further, a pinion 651 collared on a circular shaft 65 is engaged laterally with the large gear 61, wherein a protrusive press block 652 is arranged at the other end of the circular shaft 65; a pendulous article 66 is disposed right above the protrusive press block 652 so that the protrusive knob 35 of the interaction lever 34 will be driven indirectly to sway the laser gun 33 back and forth when the protrusive press block 652 is pushed to sway the pendulous article 66 right and left; and by advantage of the interaction of the pendulous article 66, pinching or hurting a finger poked into a gap unconsciously can be avoided.

A player may hold the gun body 10 of this invention to shoot disks by hand or plug it in the insertion pillar 50 on the machine base 40, then press the pushbutton 511 of the power starting device 51 to start action of the machine base 40. In addition to moving the gun body after the machine base 40, the sound and light effect is passed to the positive/negative electrode plate 112 of the handgrip 11 and the positive/negative electrode plate 52 of the insertion pillar 50 respectively to actuate the sound generator 46, so that he may pull the trigger 151 on the handgrip 11 during the sway crank 64 is swaying in virtue of the transmission device 60 to perform indirect shooting of the disks 21. At this time, the transmission device 60 drives the circular shaft 65 to sway the pendulous article 66 right and left that in turn drives the protrusive knob 35 of the interaction lever 34 to indirectly cause the laser gun 33 to sway back and forth, and thereby to shoot the disks 21 automatically with sound and light effect. In other words, this invention can be applied in a hand-held style or in a self-propelled and automatic shooting style with sound and light effect.

What is claimed is:

1. A knockdown style safety disk-shooting toy, comprising:

a gun body with sound and light effect having a gadget platform and a modeling case cover, wherein a hollow handgrip is disposed under said gun body, and a battery power device is located under the hollow handgrip; a feeding mouth is disposed axially at a front edge of said gadget platform, wherein a positioning slide channel is arranged at an inner edge of said feeding mouth; a transmission motor located in a silent seat is fixed on said gadget platform indirectly, wherein the shaft of said transmission motor points inwards slightly in a predetermined deflection angle and elevational angle; a ratchet wheel is attached at one end of said transmission motor which is coupled with a start device by a power cord; a disk-feeding device is positioned behind said feeding mouth and is disposed on said gadget platform; and a trigger is protrusively arranged laterally to said handgrip, wherein said trigger will drive a push lever on said gadget platform to feed a disk;

a feeding device being an open cylinder installed under said feeding mouth for loading a plurality of disks;

a machine base having a plurality of wheels and a deflection device located at its bottom portion to enable said machine base to deflect automatically when it bumps against another body, wherein a transmission gear and a turntable are disposed on said deflection device, and a battery box is placed laterally to said deflection device for providing battery power; a sound generator is arranged on said battery box, and an insertion pillar is built on said machine base; the abovesaid being characterized in:

said handgrip having a positive/negative electrode plate located at one side thereof for communicating with sound and light effect; a protrusive snap dot being formed on each of two lateral faces of said handgrip, and an insert-to-fix knob being disposed at an opposite lateral wall of said positioning slide channel;

said start device containing a sway block pivotally disposed at an adjacency of said feeding mouth, wherein an outer edge at one end of said sway block is extended inwards while an ON/OFF switch is placed under the other; the switch is connected with the battery power and the transmission motor respectively by a power cord; and the start device is used to start the transmission motor for driving said ratchet wheel to rotate at high speed; and said feeding device having an insert-to-fix hole formed in its circumference for grasping said insert-to-fix knob of the gun body to prevent said feeding device from slipping downwards;

a thrust device on said gadget platform being formed by disposing a long rod on each side of a crank, and the long rods being extended over said gadget platform to form barrels of a laser gun with sound and light effect, wherein said crank is driven by an interaction lever to enable said laser gun to sway back and forth, and a protrusive knob being jointed with a tail end of said interaction lever and located outside said handgrip;

said insertion pillar being a hollow body for inserting said handgrip of said gun body to form an integral unit, wherein a pushbutton of a power starting device is disposed laterally in said insertion pillar, and when a user keeps said pushbutton pressed, the power supply is started; above said power starting device, a positive/negative electrode plate is arranged to connect with said sound generator, wherein a dimple is formed at a top end of an inner edge of each lateral face on said insertion pillar; a press knob is disposed at an outer side of said dimple for snap-fixing said protrusive snap dot of said handgrip when said gun body is combined with said machine base so that the combination can be separated again by pressing said press knob; and a transmission device is disposed under said insertion pillar.

2. The knockdown style safety disk-shooting toy of claim 1, wherein said transmission device is substantially a large gear engaged with said transmission gear of said deflection device, wherein a cam with a plurality of tappets is pivotally disposed above said large gear; a slide rod with a protrusive piece at its one end is interfaced between said cam and said large gear so that said slide rod can be driven to move right and left following movement of said protrusive piece according to rotation of said cam; a weight block protrusively arranged at the other end of said slide rod is used to push one end of a sway crank located laterally to said insertion pillar; and a press block is fixed at the other end of said sway crank for pressing said trigger of said handgrip to shoot a disk indirectly; further, a pinion collared on a circular shaft is engaged laterally with said large gear, wherein a protrusive press block is arranged at the other end of said circular shaft; a pendulous article is disposed right above said protrusive press block so that said protrusive knob of said interaction lever will be driven indirectly to sway said laser gun back and forth when said protrusive press block is pushed to sway said pendulous article right and left; and by advantage of the interaction of said pendulous article, pinching or hurting a finger poked into a gap unconsciously can be avoided.

* * * * *